US007174876B2

(12) United States Patent
Suzuki et al.

(10) Patent No.: US 7,174,876 B2
(45) Date of Patent: Feb. 13, 2007

(54) CONTROL APPARATUS FOR DRY SUMP TYPE INTERNAL COMBUSTION ENGINE

(75) Inventors: Takao Suzuki, Numazu (JP); Hidenori Usui, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 11/258,888

(22) Filed: Oct. 27, 2005

(65) Prior Publication Data

US 2006/0102429 A1 May 18, 2006

Related U.S. Application Data

(63) Continuation of application No. PCT/JP05/11194, filed on Jun. 13, 2005.

(30) Foreign Application Priority Data

Jun. 22, 2004 (JP) ..... 2004-183536

(51) Int. Cl.
*F01M 1/02* (2006.01)

(52) U.S. Cl. ..... 123/196 R; 184/6.13

(58) Field of Classification Search ..... 123/196 R; 184/6.13

See application file for complete search history.

(56) References Cited

U.S. PATENT DOCUMENTS

| | | | |
|---|---|---|---|
| 2,453,217 | A | 11/1948 | Gregg et al. |
| 2,581,886 | A | 1/1952 | Rockwell |

FOREIGN PATENT DOCUMENTS

| | | |
|---|---|---|
| FR | 2 673 676 | 9/1992 |
| GB | 828181 | 2/1960 |
| JP | U 03-17213 | 2/1991 |
| JP | A 05-005409 | 1/1993 |
| JP | A 06-042325 | 2/1994 |
| JP | Y2 06-10110 | 3/1994 |
| JP | A 2000-337119 | 12/2000 |
| JP | A 2001-020715 | 1/2001 |

*Primary Examiner*—Noah P. Kamen
(74) *Attorney, Agent, or Firm*—Oliff & Berridge, PLC

(57) ABSTRACT

A feed pump 28 that is driven by the axial torque of an internal combustion engine 10 is installed. An electric scavenge pump 36 is installed. A base value for the ratio (S/F ratio) between the discharge volume of the scavenge pump 36 and feed pump 28 is calculated. The base value is corrected so that the S/F ratio is lower in a region where the engine speed is high than in a region where the engine speed is low. The discharge volume of the scavenge pump 36 is controlled in accordance with the S/F ratio that is corrected in the above manner.

6 Claims, 6 Drawing Sheets

CONTROL APPARATUS FOR DRY SUMP TYPE INTERNAL COMBUSTION ENGINE

This is a Continuation of Application No. PCT/JP2005/011194 filed Jun. 13, 2005, which claims the benefit of Japanese Patent Application No. 2004-183536 filed Jun. 22, 2004. The entire disclosure of the prior applications is hereby incorporated by reference herein in its entirety.

TECHNICAL FIELD

The present invention relates to a control apparatus for a dry sump type internal combustion engine, and more particularly to a control apparatus for a dry sump type internal combustion engine that includes a scavenge pump whose discharge volume can be changed without depending on the engine speed.

BACKGROUND ART

A conventional dry sump type internal combustion engine control apparatus is disclosed, for instance, by Japanese Patent Laid-Open No. 2000-337119. This control apparatus includes an electric feed pump for supplying oil from an oil tank, which is positioned outside a crank chamber, into the crank chamber. This control apparatus also includes an electric scavenge pump for causing an oil tank to collect the oil that is supplied from the electric feed pump to various sections of the internal combustion engine and dripped into an oil pan, which is provided at the bottom of the crank chamber. Further, the above conventional control apparatus controls the rotation speed of the electric scavenge pump in accordance with the oil level of the oil pan or oil tank. The above conventional control apparatus makes it possible to properly maintain the oil levels of the oil pan and oil tank while minimizing the drive energy for the electric scavenge pump.

Including the above-mentioned document, the applicant is aware of the following documents as a related art of the present invention.

[Patent Document 1] Japanese Patent Laid-Open No. 2000-337119

[Patent Document 2] Japanese Patent Laid-Open No. Hei 06-042325

[Patent Document 3] Japanese Patent Laid-Open No. Hei 05-005409

[Patent Document 4] Japanese Utility Model Publication No. Hei-06-10110

[Patent Document 5] Japanese Patent Laid-Open No. 2001-020715

[Patent Document 6] Japanese Utility Model Laid-open No. Hei 03-17213

DISCLOSURE OF INVENTION

In general, the oil circulation amount demanded by the internal combustion engine increases with an increase in the engine speed. In the dry sump type internal combustion engine, therefore, the feed pump discharge volume (rotation speed) increases with an increase in the engine speed. The scavenge pump is driven not only to collect the oil in the crank chamber but also to facilitate ventilation of the crank chamber. Therefore, the scavenge pump is given a higher discharge volume (rotation speed) than the feed pump. More specifically, the scavenge pump is configured to operate at a discharge volume (rotation speed) that is obtained by multiplying the feed pump's discharge volume (rotation speed) by a predetermined ratio (greater than 1). In a common dry sump type internal combustion engine, therefore, the scavenge pump's discharge volume (rotation speed) increases when the feed pump's discharge volume (rotation speed) increases with an increase in the engine speed.

When, in the above conventional apparatus, the feed pump's discharge volume (rotation speed) increases with an increase in the engine speed, thereby increasing the electric scavenge pump's discharge volume (rotation speed), the pump drive loss increases (the pump mechanical loss and pump work increase). As a result, the power consumption increases with an increase in the engine speed. If the employed scavenge pump is not motor driven but driven by the internal combustion engine's axial torque, the fuel efficiency decreases with an increase in the engine speed when the pump drive loss increases. It is therefore preferred that the aforementioned ratio, which is used to determine the scavenge pump's discharge volume (rotation speed), be determined while considering the relationship between the effect of scavenge pump drive and energy consumption depending on the internal combustion engine operation status.

The present invention has been made to solve the above problem. It is an object of the present invention to provide a dry sump type internal combustion engine control apparatus that is capable of exercising appropriate control over scavenge pump drive in accordance with the internal combustion engine operation status.

The above object is achieved by a control apparatus for a dry sump type internal combustion engine according to a first aspect of the present invention. The control apparatus for a dry sump type internal combustion engine includes a feed pump whose discharge volume varies with an engine speed and a scavenge pump whose discharge volume can be changed without depending on the engine speed. A pump control device is provided for controlling the scavenge pump in such a manner that a discharge volume ratio between the discharge volume of the scavenge pump and the discharge volume of the feed pump in a region within which the engine speed is high is lower than the discharge volume ratio in a region within which the engine speed is low.

In a second aspect of the present invention, the control apparatus for a dry sump type internal combustion engine according to the first aspect of the present invention may further include discharge volume ratio acquisition means for acquiring the discharge volume ratio. Discharge volume ratio adjustment means may be provided for making adjustments so that the discharge volume ratio is lower in a region within which the engine speed is high than in a region within which the engine speed is low. The pump control device may control the discharge volume of the scavenge pump in accordance with the discharge volume ratio that is adjusted by the discharge volume ratio adjustment means.

In a third aspect of the present invention, the control apparatus for a dry sump type internal combustion engine according to the second aspect of the present invention may further include a NOx density sensor for detecting the NOx density within a crank chamber. The discharge volume ratio adjustment means may make adjustments so that the discharge volume ratio is higher when the NOx density is high than when the NOx density is low.

The above object is achieved by a control apparatus for a dry sump type internal combustion engine according to a fourth aspect of the present invention. The control apparatus for a dry sump type internal combustion engine includes a feed pump whose rotation speed varies with an engine speed and a scavenge pump whose rotation speed can be changed without depending on the engine speed, the control apparatus comprising. A pump control device is provided for controlling the scavenge pump in such a manner that a rotation speed ratio between the rotation speed of the scavenge pump and the rotation speed of the feed pump in a region within which the engine speed is high is lower than the rotation speed ratio in a region within which the engine speed is low.

In a fifth aspect of the present invention, the control apparatus for a dry sump type internal combustion engine according to the fourth aspect of the present invention may further include rotation speed ratio acquisition means for acquiring the rotation speed ratio. Rotation speed ratio adjustment means may be provided for making adjustments so that the rotation speed ratio is lower in a region within which the engine speed is high than in a region within which the engine speed is low. The pump control device may control the rotation speed of the scavenge pump in accordance with the rotation speed ratio that is adjusted by the rotation speed ratio adjustment means.

In a sixth aspect of the present invention, the control apparatus for a dry sump type internal combustion engine according to the fifth aspect of the present invention may further include a NOx density sensor for detecting the NOx density within a crank chamber. The rotation speed ratio adjustment means may make adjustments so that the rotation speed ratio is higher when the NOx density is high than when the NOx density is low.

The first aspect of the present invention controls the increase in the energy consumption in a high rotation speed region and sufficiently reduces the NOx density in a low rotation speed region by providing the crank chamber with increased ventilation, thereby effectively controlling the deterioration of oil. In other words, the present invention makes it possible to establish a system that is capable of producing the effects of scavenge pump drive in a low rotation speed region, which is an actual normal operation region for the internal combustion engine.

The second aspect of the present invention makes adjustments so that the discharge volume ratio used in a high rotation speed region is lower than the discharge volume ratio used in a low rotation speed region. Therefore, the present invention makes it possible to control the increase in the energy consumption in a high rotation speed region and sufficiently reduce the NOx density in a low rotation speed region by providing the crank chamber with increased ventilation, thereby effectively controlling the deterioration of oil.

The third aspect of the present invention provides crank chamber ventilation with higher accuracy than the second aspect of the present invention.

BEST MODE FOR CARRYING OUT THE INVENTION

First Embodiment

[Configuration of First Embodiment]

Figure 1:
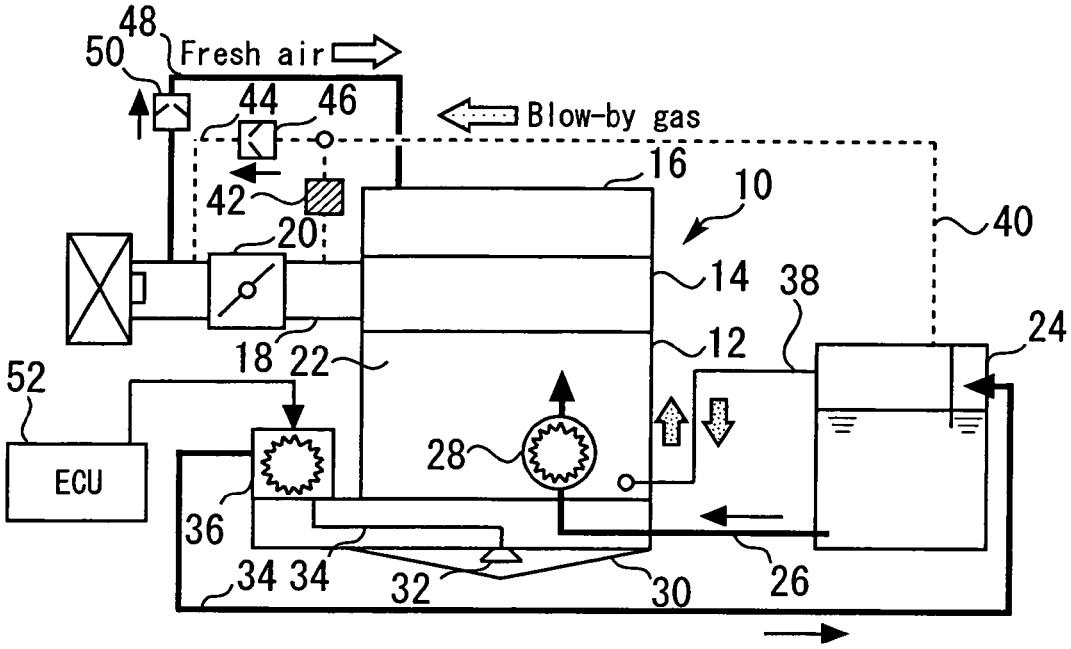
FIG. 1 illustrates the configuration of a dry sump type internal combustion engine according to a first embodiment of the present invention.

FIG. 1 illustrates the configuration of a dry sump type internal combustion engine according to a first embodiment of the present invention. The internal combustion engine 10 shown in FIG. 1 includes a cylinder block 12. A cylinder head 14 is mounted on the top of the cylinder block 12. A head cover 16 is mounted on the top of the cylinder head 14. The cylinder head 14 communicates with an intake path 18. The intake path 18 is provided with a throttle body 20, which is positioned downstream of an air cleaner.

A crank chamber 22 is formed within the cylinder block 12. The crank chamber 22 is positioned below a piston (not shown). The system according to the present embodiment includes an oil tank 24, which stores the oil that is to be supplied to various sections of the internal combustion engine 10. The bottom of the oil tank 24 communicates with one end of an oil supply pipe 26. The remaining end of the oil supply pipe 26 communicates with an oil gallery (not shown), which is formed in the cylinder block 12. A feed pump 28 is provided in the middle of the oil supply pipe 26. The feed pump 28 is driven by the axial torque of the internal combustion engine 10.

An oil pan 30 is installed below the cylinder block 12 to collect the oil that freely falls into the crank chamber 22 after being supplied to various sections of the engine by the feed pump 28. An oil strainer 32 is positioned at a predetermined distance from the bottom of the oil pan 30. The oil strainer 32 communicates with an oil collection pipe 34. An electric scavenge pump 36 is provided in the middle of the oil collection pipe 34. The remaining end of the oil collection pipe 34 communicates with the top of the oil tank 24.

The scavenge pump 36 has a greater discharge volume than the feed pump 28 in order to collect the oil that is supplied to the engine by the feed pump 28 and discharge a blow-by gas from the crank chamber 22. More specifically, the scavenge pump 36 is configured to operate at a discharge volume that is obtained by multiplying the discharge volume of the feed pump 28 by a predetermined ratio. The predetermined ratio is defined herein as the S/F (scavenge pump discharge volume/feed pump discharge volume) ratio.

The crank chamber 22 communicates with the top of the oil tank 24 via a communication path 38 in order to maintain blow-by gas pressure equilibrium between the crank chamber 22 and oil tank 24. The top of the oil tank 24 communicates with a blow-by gas supply pipe 40. A PCV valve 42 is provided in the middle of the blow-by gas supply pipe 40. The remaining end of the blow-by gas supply pipe 40 communicates with the intake path 18 that is positioned downstream of the throttle body 20.

The blow-by gas supply pipe 40 is connected to one end of a bypass path 44, which is positioned between the oil tank 24 and PCV valve 42. The remaining end of the bypass path 44 communicates with the intake path 18 that is positioned upstream of the throttle body 20, via a check valve 46. The intake path 18 positioned upstream of the throttle body 20 communicates with a fresh air communication path 48. A check valve 50 is provided in the middle of the fresh air communication path 48. The remaining end of the fresh air communication path 48 communicates with a head cover 16.

The system according to the present embodiment includes an ECU 52. The ECU 52 is connected to various sensors, which detect the engine speed, throttle opening, and the like. The ECU 52 is also connected, for instance, to an actuator for the scavenge pump 36. The ECU 52 performs a predefined process on the basis of the outputs generated by the sensors, and exercises control so that the discharge volume of the scavenge pump 36 coincides with a desired value.

[Overview of Operation Performed by First Embodiment]

When the internal combustion engine 10 starts operating, the feed pump 28 is driven in accordance with the engine speed. The scavenge pump 36 is driven at the S/F ratio that is determined according to a predetermined rule by the ECU 52. The oil in the oil tank 24 is force-fed to the oil gallery provided in the cylinder block 12 by the feed pump 28. The oil supplied to the oil gallery falls into the crank chamber 22 after lubricating various sections of the internal combustion engine 10. The oil gathered by the oil pan 30 is discharged out of the crank chamber 22 by the scavenge pump 36, and returned to the oil tank 24 via the oil collection pipe 34.

When the scavenge pump 36 is driven, the blow-by gas in the crank chamber 22 is supplied to the oil tank 24 together with the oil. The blow-by gas supplied to the oil tank 24 is taken into the intake path 18 under an intake negative pressure. In this instance, the blow-by gas is taken into the intake path 18 at a flow rate conforming to the PCV valve opening that is determined in accordance with the intake negative pressure. If the discharge volume of the scavenge pump 36 is higher than the passage flow rate of the PCV valve 42, the internal pressure within the blow-by gas supply pipe 40 is high. In such a situation, the check valve 46 opens depending on such a gas pressure, and the blow-by gas is taken into the intake path 18 via the bypass path 44.

When the scavenge pump 36 discharges the blow-by gas out of the crank chamber 22, fresh air is introduced to the head cover 16 from the fresh air communication path 48. This promotes ventilation of the inside of the head cover 16 and the crank chamber 22, thereby preventing the oil from being deteriorated by NOx that is contained in the blow-by gas.

When the feed pump 28 and scavenge pump 36 are driven at a predetermined S/F ratio (S/F>1), the system according to the present embodiment, which has been described above, can continuously supply the oil from the oil tank 24 to the internal combustion engine 10. Further, the crank chamber 22 can be ventilated by driving the scavenge pump 36.

Figure 2:
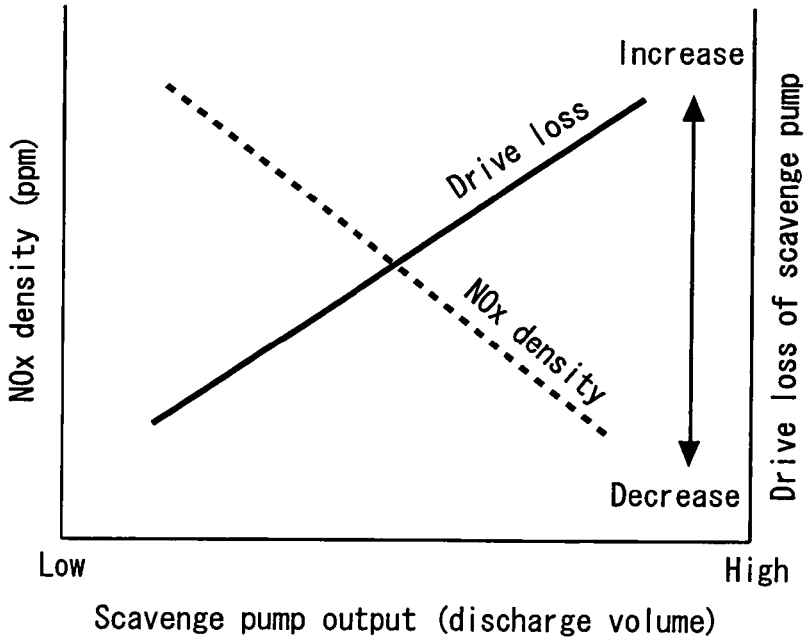
FIG. 2 illustrates the relationship between the discharge volume of the scavenge pump and the NOx density in the crank chamber or the drive loss of the scavenge pump.

FIG. 2 illustrates the relationship between the discharge volume of the scavenge pump 36 and the NOx density in the crank chamber 22 or the drive loss of the scavenge pump 36. As indicated in FIG. 2, when the rotation speed of the scavenge pump 36 is increased to increase the discharge volume of the scavenge pump 36, ventilation of the crank chamber 22 is promoted so that the NOx density in the crank chamber 22 decreases. Meanwhile, when the discharge volume of the scavenge pump 36 increases, the drive loss of the scavenge pump 36 increases (thereby increasing the degree of pump internal friction or other mechanical loss and the amount of pump work). Therefore, the power consumption increases with an increase in the discharge volume of the electric scavenge pump 36.

In general, the oil circulation amount demanded by the internal combustion engine increases with an increase in the engine speed. In the dry sump type internal combustion engine, therefore, the discharge volume of the feed pump 28 increases with an increase in the engine speed as described above. The scavenge pump 36 has a higher discharge volume than the feed pump 28 so as to provide the predetermined S/F ratio. Therefore, when the discharge volume of the feed pump 28 increases with an increase in the engine speed, the discharge volume of the scavenge pump 36 also increases.

If the S/F ratio is fixed without regard to the operation status of the internal combustion engine 10, the amount of power consumption by the scavenge pump 36, which is configured as described above, increases with an increase in the engine speed. Further, if the S/F ratio increases with an increase in the engine speed, the power consumption additionally increases with an increase in the engine speed. The discharge volume of the scavenge pump 36 needs to be higher than that of the feed pump 28 in order to exercise the oil collection function and crank chamber ventilation function. However, if the discharge volume of the scavenge pump 36 is too high in a region where the engine speed is high, the power consumption increases unduly. Meanwhile, in a region where the discharge volume of the scavenge pump 36 is low as indicated in FIG. 2, the drive loss of the scavenge pump 36 is small, so that the influence of power consumption is smaller than in a region where the discharge volume is high.

Under the above circumstances, the system according to the present embodiment provides a lower S/F ratio in a region where the engine speed is high than in a region where the engine speed is low. More specifically, a low S/F ratio is employed to give priority to power consumption minimization in a region where the engine speed is high. In a region where the engine speed is low, on the other hand, a high S/F ratio is employed to give priority to ventilation improvement for NOx density reduction because the influence of power consumption is smaller than in a region where the engine speed is high.

[Details of Processing Performed by First Embodiment]

Figure 3:
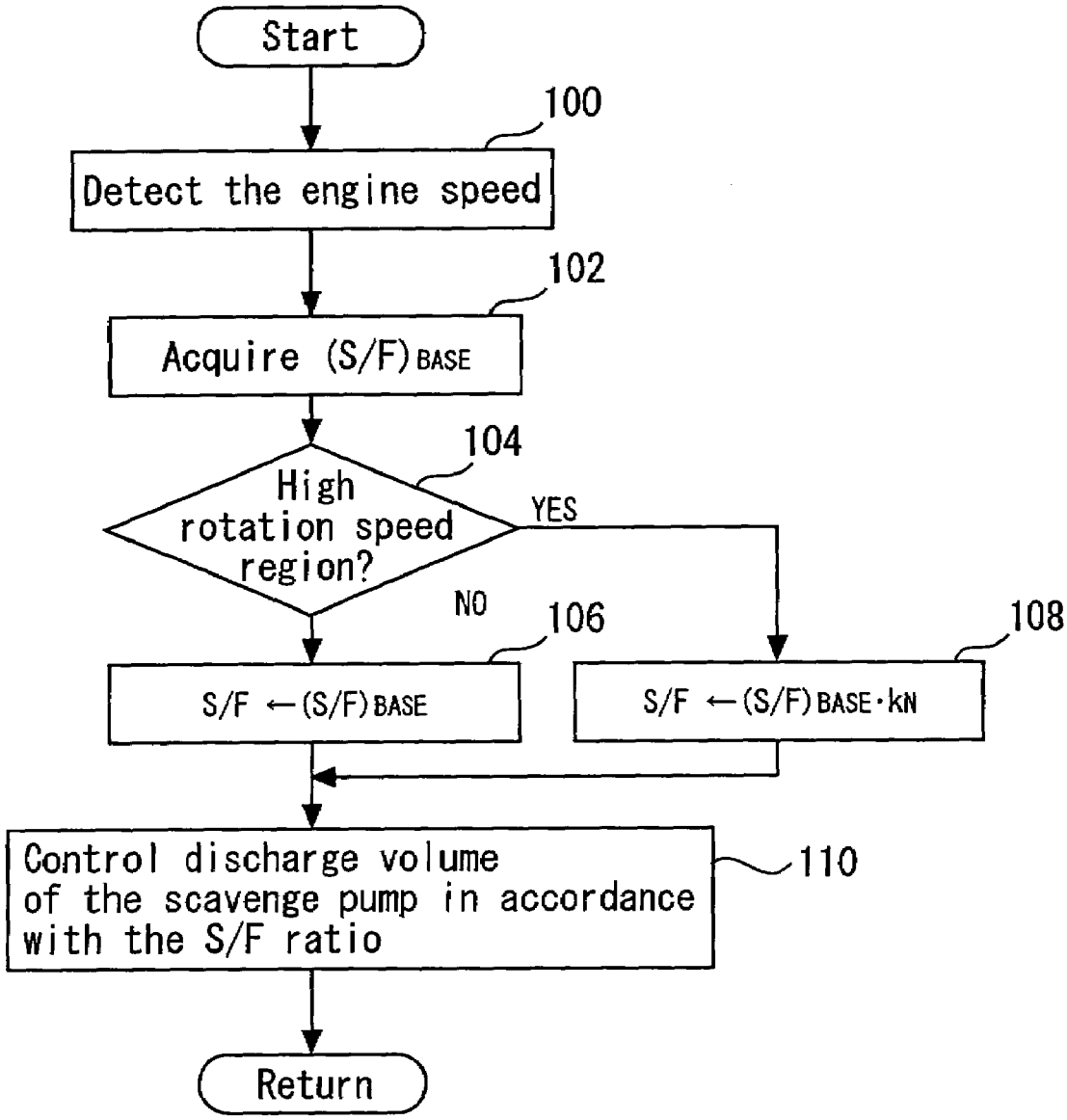
FIG. 3 is a flowchart illustrating a routine that is executed in the first embodiment of the present invention.

FIG. 3 is a flowchart illustrating a routine that the ECU 52 according to the first embodiment executes to implement the above functionality. In the routine shown in FIG. 3, step 100 is first performed to detect the engine speed. Next, step 102 is performed to acquire an S/F ratio base value $(S/F)_{BASE}$. The process performed in this routine uses a predetermined engine speed as a threshold value, divides the operation region of the internal combustion engine 10 into a low rotation speed region and a high rotation speed region, and provides different S/F ratios for the two regions. The ECU 52 stores the base value $(S/F)_{BASE}$ for S/F ratio setup. The base value $(S/F)_{BASE}$ is set so that the scavenge pump 36 can sufficiently ventilate the crank chamber 22. In the process performed in this routine, the base value $(S/F)_{BASE}$ is set as the S/F ratio for use in the low rotation speed region. The threshold engine speed for S/F ratio changeover may be set in accordance with engine speed usage frequency.

Next, step 104 is performed to judge whether the engine speed is in the high rotation speed region. If the obtained judgment result indicates that the engine speed is not in the high rotation speed region but in the low rotation speed region, step 106 is performed to set the base value $(S/F)_{BASE}$ as the S/F ratio for use in the current processing cycle.

If, on the other hand, the judgment result obtained in step 104 indicates that the engine speed is in the high rotation speed region, step 108 is performed so that the S/F ratio for use in the current processing cycle is smaller than the value for use in the low rotation speed region. More specifically, the S/F ratio for use in the current processing cycle is equal to the value $(S/F)_{BASE} \times k_N$, which is obtained by multiplying the base value $(S/F)_{BASE}$ by a predetermined correction coefficient $k_N$ ($0<k_N<1$) that is based on the engine speed.

Next, step 110 is performed to control the discharge volume of the scavenge pump 36 in accordance with the S/F ratio that is set in step 106 or 108. The ECU 52 stores maps 1 and 2. Map 1 defines the relationship between the engine speed and the discharge volume of the feed pump 28. Map 2 defines the relationship between the rotation speed and discharge volume of the scavenge pump 36. In step 110, the discharge volume of the feed pump 28, which corresponds to the engine speed, is first acquired in accordance with map 1. The discharge volume of the scavenge pump 36 is then calculated by multiplying the discharge volume of the feed pump 28 by the S/F ratio that is set in the above step. Next, the rotation speed of the scavenge pump 36 for providing the calculated discharge volume is determined in accordance with map 2. Finally, the scavenge pump 36 is controlled in such a manner as to provide the determined rotation speed.

When the process in the routine described above is performed, the discharge volume of the scavenge pump 36 can be controlled in accordance with the engine speed to provide a lower S/F ratio in the high rotation speed region than in the low rotation speed region. In other words, the scavenge pump 36 is basically controlled for a discharge volume according to the engine speed in compliance with the discharge volume of the feed pump 28. When the above process is performed, however, the discharge volume characteristic of the scavenge pump 36, which corresponds to the engine speed, is changed in accordance with the rotation speed region.

Therefore, the system according to the present embodiment minimizes the increase in the power consumption because the scavenge pump 38 is driven at an S/F ratio that is lower in the high rotation speed region than in the low rotation speed region. In the low rotation speed region, an increased degree of ventilation is provided for the crank chamber 22 to sufficiently reduce the NOx density. Consequently, it is possible to effectively control the deterioration of the oil. In the system according to the present embodiment, the ventilation performance prevailing in the high rotation speed region lowers. However, the S/F ratio providing adequate ventilation performance is set for the low rotation speed region, which is actually a frequently used operation region of the internal combustion engine 10. It is therefore possible to prevent the ventilation performance from deteriorating in the high rotation speed region. As described above, the system according to the present embodiment is capable of minimizing the increase in the power consumption in the high rotation speed region and producing adequate effects (ventilation improvement) in the low rotation speed region, which is the normal operation region, by driving the scavenge pump 36. Further, the system according to the present embodiment increases the oil life, thereby making it possible to implement a dry sump type internal combustion engine in which the oil change frequency is minimized.

In the first embodiment, which has been described above and includes the feed pump 28 whose discharge volume varies with the engine speed, the scavenge pump 36 is controlled so that the S/F ratio (which is the ratio between the discharge volume of the scavenge pump 36 and the discharge volume of the feed pump 28) prevailing in a region where the engine speed is high is lower than in a region where the engine speed is low. However, the present invention is not limited to such scavenge pump control. More specifically, the scavenge pump may be controlled on the basis of the feed pump or scavenge pump rotation speed instead of the aforementioned discharge volume when the employed configuration is such that the employed feed pump changes its rotation speed in accordance with the engine speed. In other words, the scavenge pump may be controlled so that the rotation speed ratio between the scavenge pump and feed pump is lower in a region where the engine speed is high than in a region where the engine speed is low. Even when such an alternative control scheme is employed, it is possible to minimize the increase in the amount of energy consumption in the high rotation speed region and sufficiently reduce the NOx density by providing an increased degree of crank chamber ventilation in the low rotation speed region, thereby effectively controlling the deterioration of the oil.

In the first embodiment, which has been described above, the routine shown in FIG. 3 is executed to control the discharge volume of the scavenge pump 36. However, the present invention is not limited to the use of such a scavenge pump control method. An alternative is to obtain a map or calculation formula that defines the relationship between the engine speed and scavenge pump discharge volume (or rotation speed), which provides a predetermined S/F ratio, on the basis of the relationship between the engine speed and feed pump discharge volume (or rotation speed), and control the discharge volume (or rotation speed) of the scavenge pump in accordance with the map or calculation formula. Another alternative is to control the discharge volume (or rotation speed) of the scavenge pump in accordance with the feed pump discharge volume (or rotation speed), on the basis of the relationship between the engine speed and feed pump discharge volume (or rotation speed).

The first embodiment, which has been described above, divides the operation region of the internal combustion engine 10 into the low and high rotation speed regions and applies different S/F ratios to the two regions. However, the present invention is not limited to the use of such S/F ratios. An alternative is to decrease the S/F ratio stepwise with an increase in the engine speed or decrease the S/F ratio continuously with an increase in the engine speed. Another alternative is to vary the S/F ratio in accordance with the engine speed and load or in accordance with the load only. More specifically, the S/F ratio setting may increase with an increase in the load imposed on the internal combustion engine 10.

In the first embodiment, which has been described above, the feed pump 28 is driven by the axial torque of the internal combustion engine 10. However, the present invention is not limited to the use of such a feed pump. More specifically, the present invention is applicable to the use of a feed pump whose discharge volume varies with the engine speed. For example, the use of an electric feed pump is acceptable. Further, the present invention is not limited to the use of an electric scavenge pump. The present invention is applicable to the use of a scavenge pump whose discharge volume can be changed without depending on the engine speed. For example, the present invention can be applied to the use of a scavenge pump whose discharge volume can be controlled with a variable pulley or other external means without depending on the engine speed. The present invention can also be applied to the use of a variable capacity type scavenge pump whose discharge volume per revolution is adjustable. Further, the present invention is applicable to a case where the discharge volume of the feed pump and scavenge pump vary continuously with the engine speed or vary intermittently with the engine speed.

Figure 4:
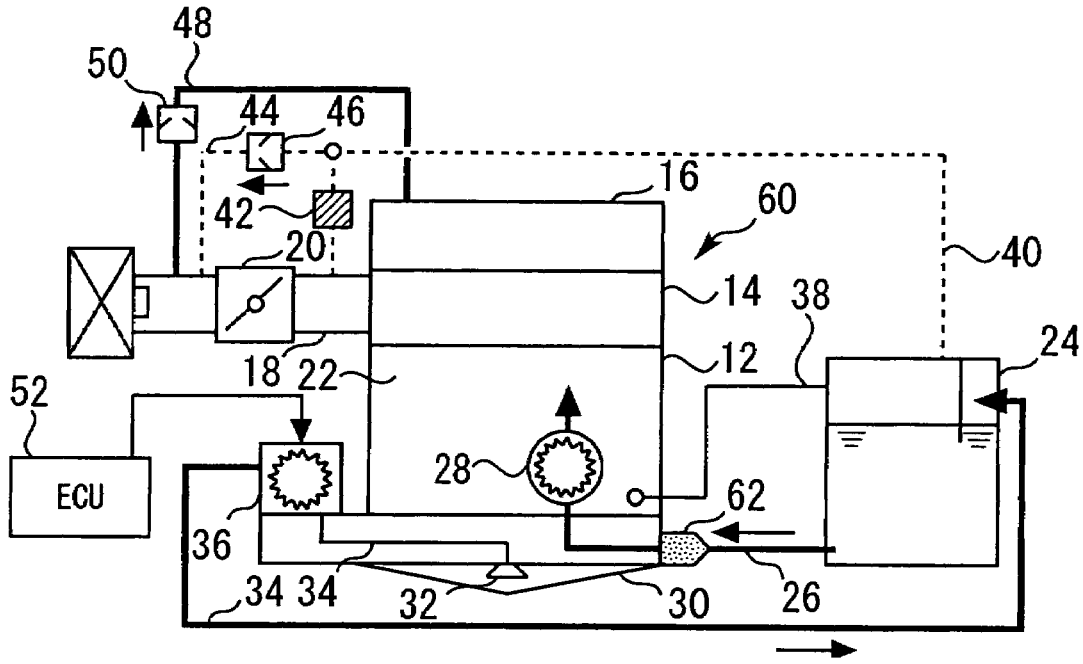
FIG. 4 illustrates the configuration of a modified example of the dry sump type internal combustion engine according to the first embodiment of the present invention.

The first embodiment, which has been described above, assumes that the present invention applies to the internal combustion engine configuration shown in FIG. 1. However, the present invention is not limited to such an internal combustion engine configuration. The present invention can also be applied to the configuration shown in FIG. 4. An internal combustion engine 60 shown in FIG. 4 has the same configuration as the internal combustion engine 10 shown in FIG. 1 except that a check valve 62 is added. As indicated in FIG. 4, the check valve 62 is installed in the oil supply pipe 26 between the oil tank 24 and feed pump 28. The check valve 62 functions only when the internal combustion engine 60 is stopped. The check valve 62 is installed to avoid an oil flow from the oil tank 24 to the crank chamber 22 while the internal combustion engine 60 is stopped. When the employed configuration includes the check valve 62, it is not necessary to consider the height difference between the oil tank 24 and oil pan 30 when determining the installation location of the oil tank 24. Therefore, the degree of design freedom for determining the mounting location of the oil tank 24 can be enhanced. Further, the internal combustion engine 60 shown in FIG. 4 may be used to exercise control as indicated in FIG. 5.

Figure 5:
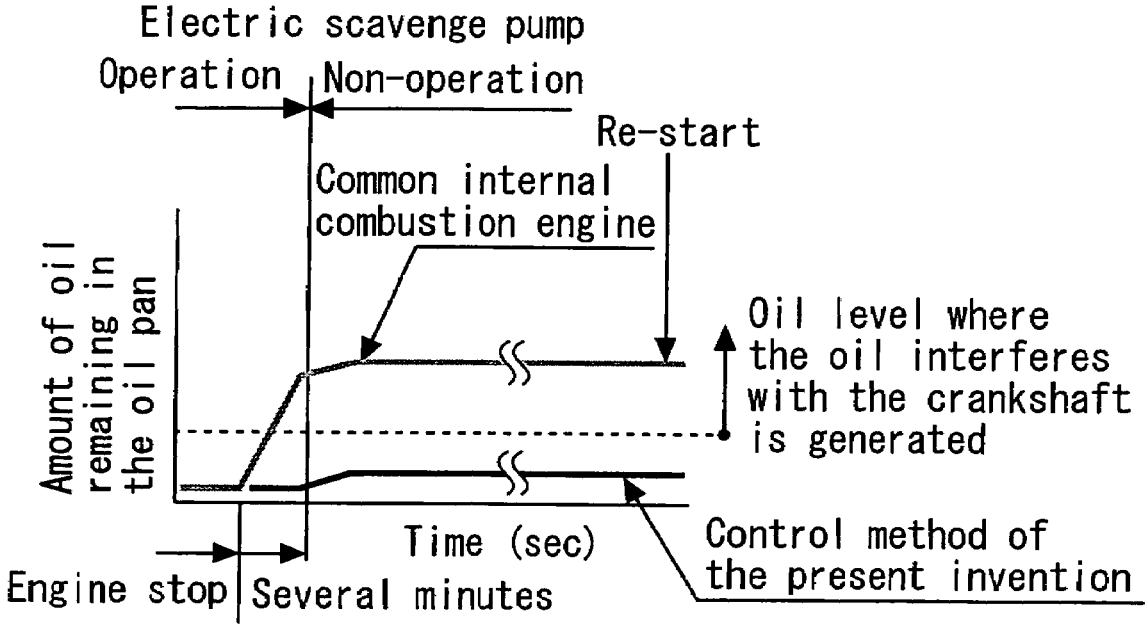
FIG. 5 illustrates the relationship between the time and the amount of oil remaining in the oil pan.

FIG. 5 illustrates the relationship between the time and the amount of oil remaining in the oil pan 30. In a common dry sump type internal combustion engine, the scavenge pump drive comes to a stop when the engine stops. For a predetermined period of time after an internal combustion engine stop, the oil that has lubricated various sections of the engine falls into the oil pan with a time lag. In a common internal combustion engine, therefore, the amount of oil remaining in the oil pan increases after an engine stop as indicated in FIG. 5. If the amount of oil remaining in the oil pan exceeds a predetermined amount before the operation starts next, the oil interferes with the crankshaft after the start of the operation. To avoid such a situation, the electric scavenge pump 36 may be continuously driven for several minutes after an engine stop. When this control method is used, the oil gathered by the oil pan 30 can be recovered by the oil tank 24 after an engine stop. This ensures that the oil does not interfere with the crankshaft when the next operation starts. Therefore, the internal combustion engine 60 properly starts up. While the engine is stopped, the scavenge pump 36 may operate before the beginning of the next startup sequence or when a certain period of time elapses after an engine stop, that is, at a predefined time at which it is judged that the oil fall into the oil pan 30 is terminated.

The first embodiment, which has been described above, assumes that the present invention applies to the internal combustion engine configuration shown in FIG. 1. However, the present invention is not limited to such an internal combustion engine configuration. The present invention can also be applied to the configuration shown in FIG. 6. An internal combustion engine 70 shown in FIG. 6 has the same configuration as the internal combustion engine 10 shown in FIG. 1 except that an oil level sensor 72 is added. As indicated in FIG. 6, the oil level sensor 72 is mounted on a sidewall for the oil tank 24, and capable of detecting the oil level in the oil tank 24.

Figure 6:
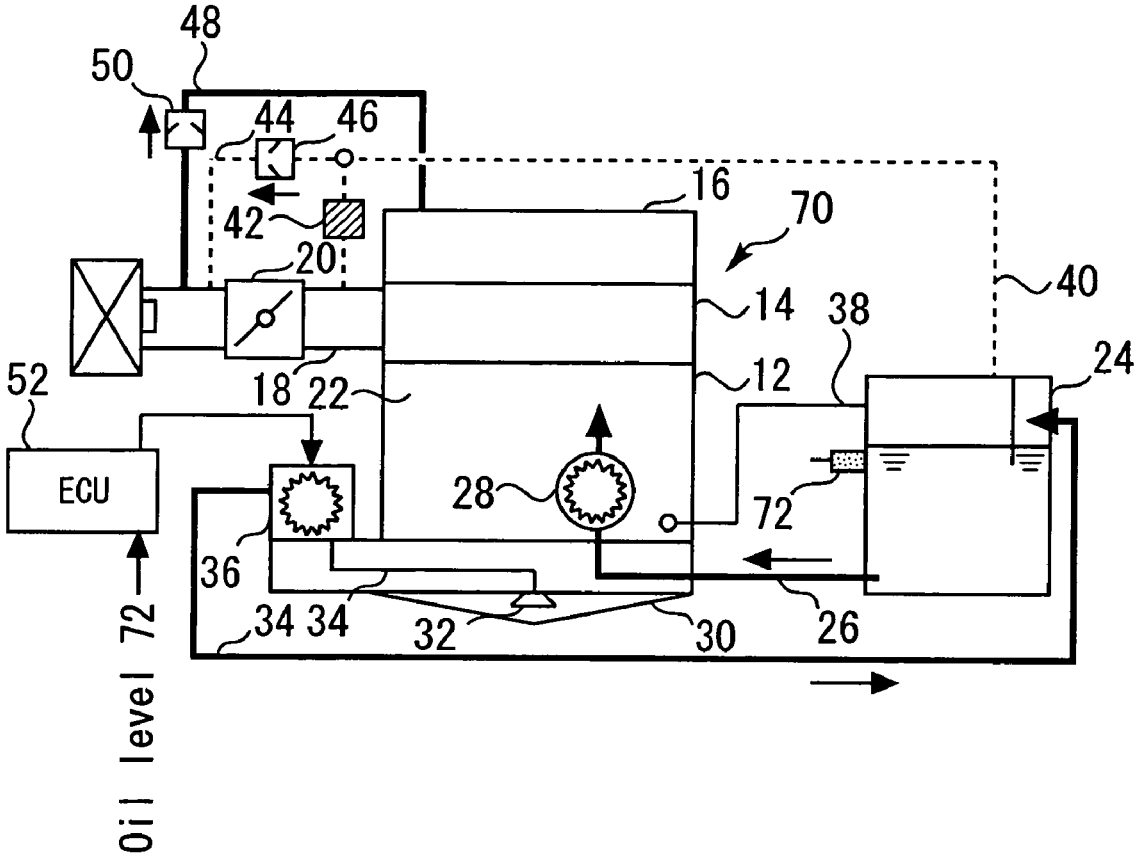
FIG. 6 illustrates the configuration of another modified example of the dry sump type internal combustion engine according to the first embodiment of the present invention.

When the operation status of a vehicle in which the internal combustion engine 70 shown in FIG. 6 is mounted changes (due, for instance, to turning or sudden acceleration/deceleration), the balance between the oil level in the oil tank 24 and the oil level in the oil pan 30 may greatly change. In such an instance, the oil in the crank chamber 22 is biased, so that the scavenge pump 36 cannot properly achieve oil collection. As a result, the oil level in the oil tank 24 lowers, so that it is difficult for the feed pump 28 to supply oil. Further, when the temperature is extremely low, the oil viscosity is high so that the oil return to the oil pan 30 is delayed. This incurs the same problem as described above. To avoid such a situation, the routine shown in FIG. 7 may be performed.

Figure 7:
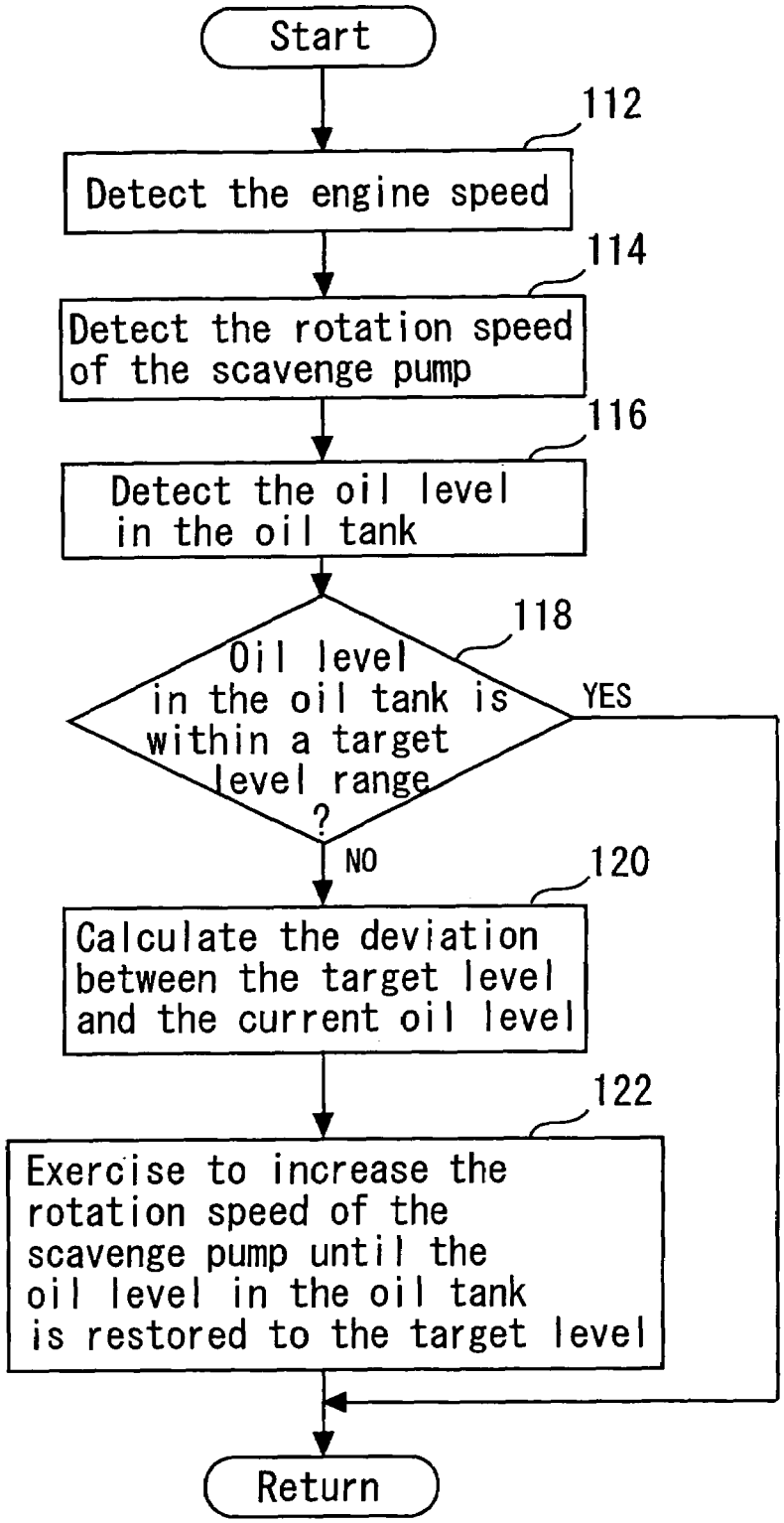
FIG. 7 is a flowchart illustrating a routine that is executed in another modified example which is shown in FIG. 6.

FIG. 7 is a flowchart illustrating a routine that the ECU 52 in the internal combustion engine 70 shown in FIG. 6 executes to avoid the above situation. In the routine shown in FIG. 7, step 112 is first performed to detect the engine speed. Step 114 is then performed to detect the rotation speed of the scavenge pump 36. In step 116, the oil level sensor 72 detects the oil level in the oil tank 24. Next, step 118 is performed to judge whether the oil level in the oil tank 24 is within a target level range.

If the judgment result obtained in step 118 indicates that the oil level in the oil tank 24 is not within the target level range, step 120 is performed to calculate the deviation between the target level and the current oil level detected in step 116. Next, control is exercised to increase the rotation speed of the scavenge pump 36 until the oil level in the oil tank 24 is restored to the target level (step 122).

When the routine shown in FIG. 7 is executed to control the discharge volume of the scavenge pump 36 in accordance with the oil level in the oil tank 24, it is possible to avoid a situation where the feed pump 28 fails to pump up the oil due to a low oil level in the oil tank 24.

In the first embodiment, which has been described above, the "pump control device" according to the first aspect of the present invention is implemented when the ECU 52 performs step 110. The "discharge volume ratio acquisition means" according to the second aspect of the present invention is implemented when the ECU 52 performs step 102. The "discharge volume ratio adjustment means" according to the second aspect of the present invention is implemented when the ECU 52 performs steps 104, 106, and 108.

Second Embodiment

A second embodiment of the present invention will now be described with reference to FIG. 8.

The system according to the present embodiment is configured the same as the first embodiment except that a NOx density sensor is incorporated to detect the NOx density in the crank chamber 22. The first embodiment, which has been described earlier, changes the S/F ratio in accordance with the engine speed. The system according to the present embodiment changes the S/F ratio in accordance with the NOx density in the crank chamber 22 as well as the engine speed.

Figure 8:
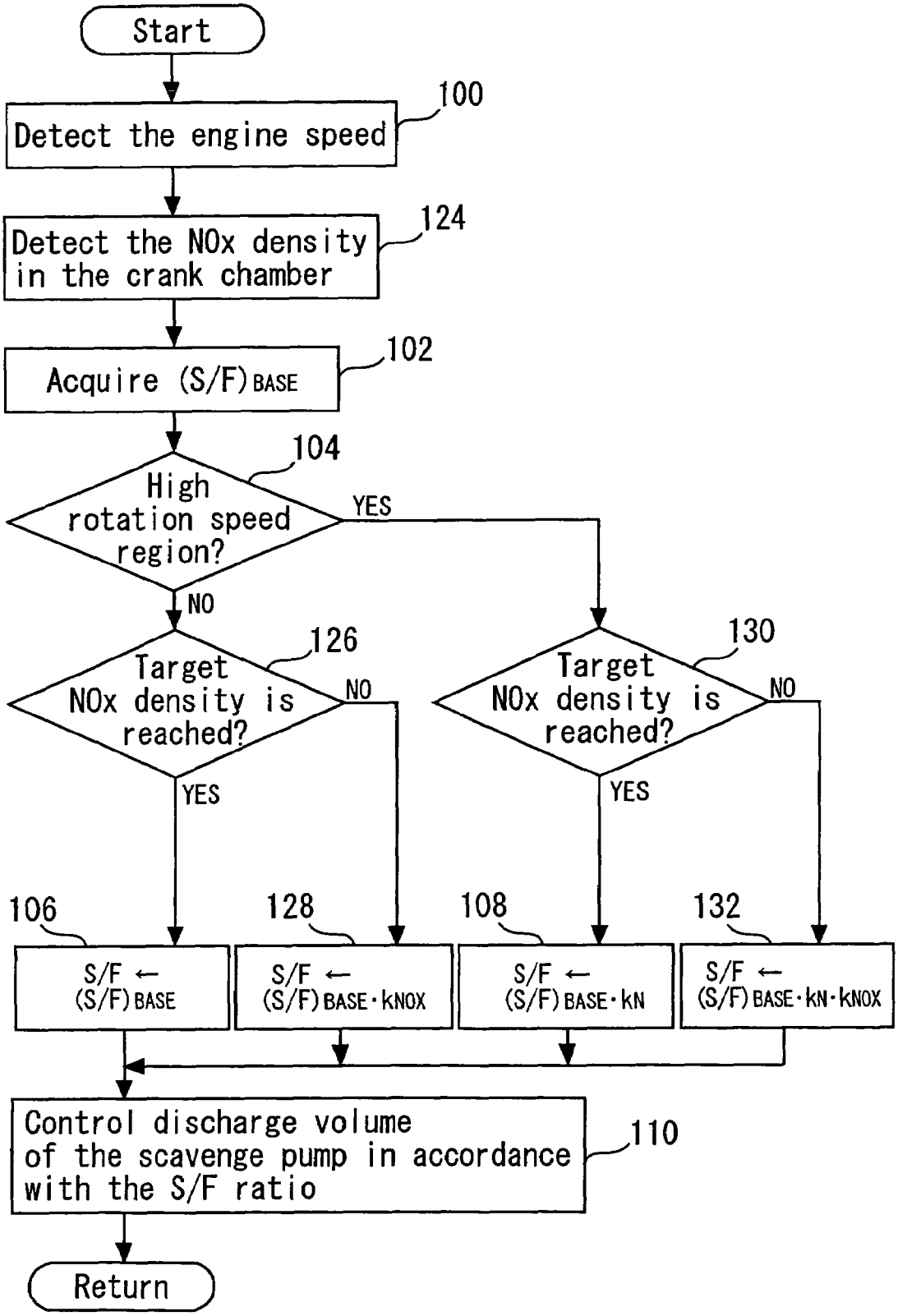
FIG. 8 is a flowchart illustrating a routine that is executed in the second embodiment of the present invention.

FIG. 8 is a flowchart illustrating a routine that the ECU 52 according to the present embodiment executes to implement the above functionality. When the present embodiment is described with reference to FIG. 8, steps identical with those described with reference to FIG. 3 for the first embodiment are designated by the same reference numerals as their counterparts and omitted from the description or briefly described. In the routine shown in FIG. 8, step 100 is first performed to detect the engine speed. Step 124 is then performed to detect the NOx density in the crank chamber 22 in accordance with the NOx density sensor output. The routine not only changes the S/F ratio in accordance with the engine speed, but also increases the S/F ratio when the NOx density in the crank chamber 22 is higher than a predetermined target NOx density. For a process that is performed in the routine, the base value $(S/F)_{BASE}$ stored by the ECU 52 is set as the S/F ratio for use in the low rotation speed region and as the S/F ratio for use in a situation where the target NOx density is reached.

If the judgment result obtained in step 104 indicates that the engine is not in the high rotation speed region, step 126 is performed to judge whether the target NOx density is reached.

If the judgment result obtained in step 126 indicates that the target NOx density is reached, the base value (S/F) BASE is set as the S/F ratio for use in the current processing cycle (step 106).

If, on the other hand, the judgment result obtained in step 126 indicates that the target NOx density is not reached, the S/F ratio for use in the current processing cycle is set higher than when the NOx density is not higher than the target density (step 128). More specifically, the base value $(S/F)_{BASE}$ is multiplied by a predetermined NOx density based correction coefficient $k_{NOX}$ ($k_{NOX}>1$), and the resulting value $(S/F)_{BASE}\times k_{NOX}$ is set as the S/F ratio for use in the current processing cycle.

When the judgment result obtained in step 104 indicates that the engine is in the high rotation speed region, step 130 is performed to judge whether the target NOx density is reached. If the obtained judgment result indicates that the target NOx density is reached, the base value $(S/F)_{BASE}$ is multiplied by a predetermined engine speed based correction coefficient $k_N$, and the resulting value $(S/F)_{BASE}\times k_N$ is set as the S/F ratio for use in the current processing cycle (step 108).

If, on the other hand, the judgment result obtained in step 130 indicates that the target NOx density is not reached, the base value $(S/F)_{BASE}$ is multiplied by the engine speed based correction coefficient $k_N$ and by the NOx density based correction coefficient $k_{NOX}$, and the resulting value $(S/F)_{BASE}\times k_N\times k_{NOX}$ is set as the S/F ratio for use in the current processing cycle (step 132).

Next, step 110 is performed to control the discharge volume of the scavenge pump 36 in accordance with the S/F ratio that is set in step 106, 128, 108, or 132.

The routine described above controls the discharge volume of the scavenge pump 36 in such a manner as to provide an S/F ratio in accordance with the NOx density in the crank chamber 22 as well as with the engine speed. Therefore, the system according to the present embodiment can ventilate the crank chamber 22 with higher accuracy than the configuration according to the first embodiment. In other words, when the target NOx density is reached in the crank chamber 22, the system according to the present embodiment does not have to provide ventilation at an excessive capacity. As a result, it is possible to minimize the power consumption and provide a system that uses energy with high efficiency.

The second embodiment, which has been described above, uses different S/F ratios depending on whether the target NOx density is reached. However, the present invention is not limited to such S/F ratio use. Alternatively, the employed S/F ratio may increase with an increase in the NOx density.

The invention claimed is:

1. A control apparatus for a dry sump type internal combustion engine, which includes a feed pump whose discharge volume varies with an engine speed and a scavenge pump whose discharge volume can be changed without depending on the engine speed, the control apparatus comprising:

a pump control device for controlling said scavenge pump in such a manner that a discharge volume ratio between the discharge volume of said scavenge pump and the discharge volume of said feed pump in a region within which the engine speed is high is lower than the discharge volume ratio in a region within which the engine speed is low.

2. The control apparatus for the dry sump type internal combustion engine according to claim 1, the control apparatus comprising:

discharge volume ratio acquisition means for acquiring the discharge volume ratio; and discharge volume ratio adjustment means for making adjustments so that the discharge volume ratio is lower in a region within which the engine speed is high than in a region within which the engine speed is low;

wherein the pump control device controls the discharge volume of said scavenge pump in accordance with the discharge volume ratio that is adjusted by said discharge volume ratio adjustment means.

3. The control apparatus for the dry sump type internal combustion engine according to claim 2, the control apparatus comprising:

a NOx density sensor for detecting the NOx density within a crank chamber;

wherein said discharge volume ratio adjustment means makes adjustments so that the discharge volume ratio is higher when the NOx density is high than when the NOx density is low.

4. A control apparatus for a dry sump type internal combustion engine, which includes a feed pump whose rotation speed varies with an engine speed and a scavenge pump whose rotation speed can be changed without depending on the engine speed, the control apparatus comprising:

a pump control device for controlling said scavenge pump in such a manner that a rotation speed ratio between the rotation speed of said scavenge pump and the rotation speed of said feed pump in a region within which the engine speed is high is lower than the rotation speed ratio in a region within which the engine speed is low.

5. The control apparatus for the dry sump type internal combustion engine according to claim 4, the control apparatus comprising:

rotation speed ratio acquisition means for acquiring the rotation speed ratio; and rotation speed ratio adjustment means for making adjustments so that the rotation speed ratio is lower in a region within which the engine speed is high than in a region within which the engine speed is low;

wherein the pump control device controls the rotation speed of said scavenge pump in accordance with the rotation speed ratio that is adjusted by the rotation speed ratio adjustment means.

6. The control apparatus for the dry sump type internal combustion engine according to claim 5, the control apparatus comprising:

a NOx density sensor for detecting the NOx density within a crank chamber, wherein said rotation speed ratio adjustment means makes adjustments so that the rotation speed ratio is higher when the NOx density is high than when the NOx density is low.

* * * * *

UNITED STATES PATENT AND TRADEMARK OFFICE

CERTIFICATE OF CORRECTION

PATENT NO. : 7,174,876 B2
APPLICATION NO. : 11/258888
DATED : February 13, 2007
INVENTOR(S) : Takao Suzuki and Hidenori Usui It is certified that error appears in the above-identified patent and that said Letters Patent is hereby corrected as shown below:

Title page
In Item [73] Assignee, add the second joint assignee --Aisin Seiki Kabushiki Kaisha, Kariya-Shi (JP)--.

Signed and Sealed this

Tenth Day of July, 2007

JON W. DUDAS
*Director of the United States Patent and Trademark Office*